US005765922A

United States Patent [19]

Hsia

[11] Patent Number: 5,765,922

[45] Date of Patent: Jun. 16, 1998

[54] PORTABLE COMBINATION CHAIR

[75] Inventor: Ben M. Hsia, Santa Clarita, Calif.

[73] Assignee: MTS Products, Santa Clarita, Calif.

[21] Appl. No.: 791,485

[22] Filed: Jan. 27, 1997

[51] Int. Cl.[6] ..... A47C 7/00

[52] U.S. Cl. ..... 297/440.1; 297/440.13; 297/440.23

[58] Field of Search ..... 297/440.1, 440.13, 297/440.14, 440.23

[56] References Cited

U.S. PATENT DOCUMENTS

| | | | |
|---|---|---|---|
| 2,792,877 | 5/1957 | West, Jr. | 297/440.13 |
| 3,547,491 | 12/1970 | Bovasso | 297/440.13 |
| 4,593,950 | 6/1986 | Infanti | 297/440.13 X |
| 5,000,514 | 3/1991 | Hanson | 297/440.13 |
| 5,082,329 | 1/1992 | Mars | 297/440.13 |

*Primary Examiner*—Laurie K. Cranmer
*Attorney, Agent, or Firm*—David & Raymond; Raymond Y. Chan

[57] ABSTRACT

A portable combination chair includes a seat member having a back slot, a left slot and a right slot, a back supporting member having a left connecting wing and a right connecting wing protruded at the two bottom side thereof, a right arm resting member having a rear slot, and a left arm resting member also having a rear slot. The back supporting member is assembled with the left and right arm resting members by inserting the left and right connecting wings through the two rear slots of the left and right arm resting members respectively, in which the bottom side of each connecting wing has a connecting groove indented thereon for engaging with the two rear slots of the left and right arm resting members. The seat member is assembled by inserting the back supporting member and the left and right arm resting members through the back slot, the left slot and the right slot respectively until a bottom surface of the seat member is rested on at least a supporting shoulder formed on the left and the right arm resting member. Thereby, the portable combination chair can help developing the creativity of the children and provide a stable and tightly constructed chair which can be disassembled and reassembled without affecting the desire connection strength.

20 Claims, 3 Drawing Sheets

PORTABLE COMBINATION CHAIR

BACKGROUND OF THE PRESENT INVENTION

The present invention relates in general to furniture and toy for children, and more particularly to a portable combination chair for children, which enables children to disassemble and reassemble their own chair easily in combination of different color, shape and art form.

All the children have creativity born with them, and the best time to develop this creativity is during the early stage of child development. There need to be some guidance and chance to practice, that is why children play with clay, building blocks, and even computer games such as tetris. The conventional chairs for children whether made of wood or plastic are mostly already assembled rigidly in one body, with preset size, color, shape, and art form. If we can prepare different parts of chair and allow the children to design and put together their own chairs, what better exercise than this real life building and practical use can get?

One great disadvantage of the conventional chairs for children is that most of them are integrally connected in one body and is not built for repeatedly reassemble the disassemble parts back into a chair, which takes up a large space. The family with young children often travels in vehicle to the neighborhood park in the afternoon or goes picnic on weekend. Those one piece children chair is very inconvenience to carry in vehicle, that is why you seldom see family outing with special chair for children. If you try to disassemble the conventional chair would enlarge the screw holes thus affecting the desire connection strength. When the chair is not in use, the chair required a large storage spacing and can not be storage away in a storage room.

SUMMARY OF THE PRESENT INVENTION

The main objective of the present invention is to provide a portable combination chair adapted for the children to easily assemble and disassemble the members to form a rigid chair which maintains a desired connection strength all the time.

Another objective of the present invention is to provide a portable combination chair which comprises merely a minimum number of members and is light in weight for easy carry and storage.

Another objective of the present invention is to provide a portable combination chair wherein all the assembling members may have different color, shape, and art form, so that the children can reassemble the chair in accordance with their design, so as to help the children to be more creative.

Another objective of the present invention is to provide a portable combination chair which has a safety protrusion construction so that when the children put the chair members together, the chair would be stable and tightly constructed.

Another objective of the present invention is to provide a portable combination chair which can be disassemble and stored away when the chair is not in used.

Accordingly, a portable combination chair comprises a seat member, a back supporting member and a left and a right arm resting members.

The seat member has an elongate back slot provided at a back side edge thereof, an elongated left slot and an elongated right slot provided at a left side edge and a right side edge of the seat member respectively.

The back supporting member has an upper back supporting portion and a lower connecting portion extending downwards from the upper back supporting portion. The lower connecting portion has a left and a right connecting wing integrally extended downwardly and outwardly therefrom respectively. The upper back supporting portion has a width and a thickness slightly smaller than a length and a width of the back slot of the seat member respectively, wherein the left and right connecting wings of the lower connecting portion are protruded outwardly from a left side edge and a right side edge of the upper back supporting portion respectively. The left connecting wing has a left connecting groove, which has a predetermined depth and a predetermined width, indented at a bottom end of the left connecting wing. The right connecting wing also has a right connecting groove, which has a predetermined depth and a predetermined width, indented at a bottom end of the right connecting wing.

Each of the left arm resting member and the right arm resting member has an upper resting portion extending upwardly, which has a narrowed width in order to define a front supporting shoulder and a rear supporting shoulder extending frontwardly and rearwardly from a front side and a rear side of the upper arm resting portion respectively. The width of the left and right upper arm resting portions is smaller than a length of the left and the right slot of the seat member respectively. Each of the left and right arm resting members further has a rear slot, which has a length longer than a height of the left and the right wing respectively, adapted for enabling the left and right wings to pass through respectively.

Whereby, the back supporting member is capable of locking with the left arm resting member and the right arm resting member by downwardly engaging the two connecting grooves of the two connecting wings respectively with a bottom end portion of the rear slot of the left arm resting member and a bottom end portion of the rear slot of the right arm resting member respectively. Moreover, the seat member is assembled by inserting the upper back supporting portion of the back supporting member and the upper arm resting portions of the left and right arm resting members through the back slot and the left and right slots of the seat member respectively, until a bottom surface of the seat member is rested on the front supporting shoulders and the rear supporting shoulders of the left and right arm resting members respectively.

DETAILED DESCRIPTION OF THE PREFERRED EMBODIMENT

Figure 1:
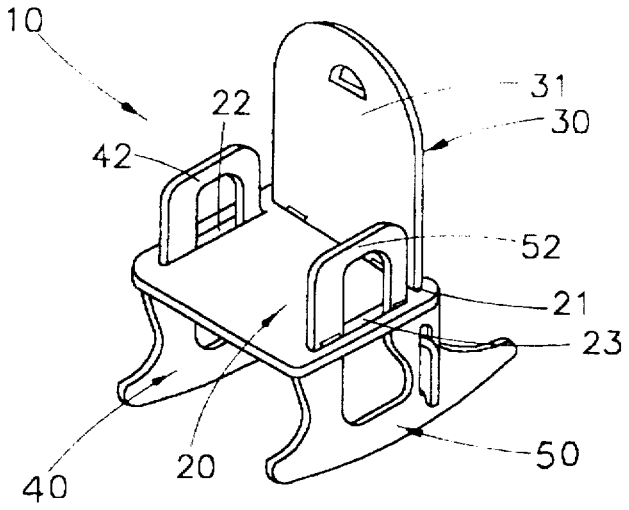
FIG. 1 is a perspective view of a portable combination chair of a first preferred embodiment of the present invention.
Figure 2:
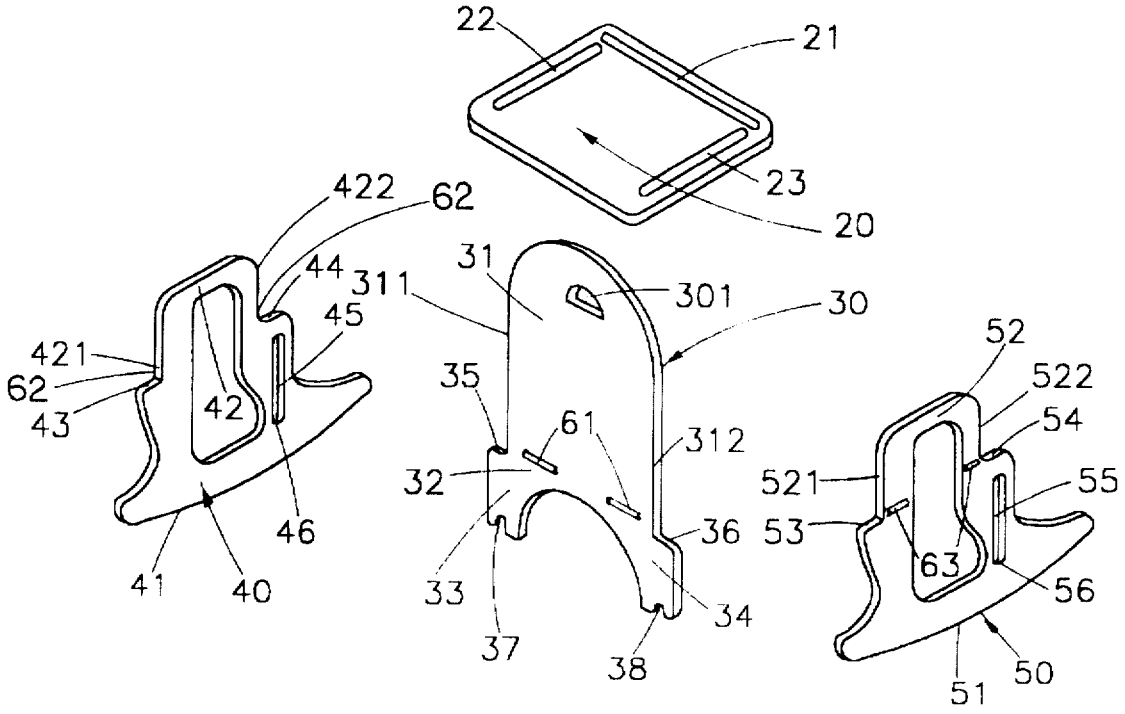
FIG. 2 is an exploded perspective view of the portable combination chair according to the above first preferred embodiment of the present invention.

Referring to FIGS. 1 and 2 of the drawings, a portable combination chair 10 for children of the present invention comprises a seat member 20, a back supporting member 30, a left arm resting member 40, a right arm resting member 50, and a securing means 60 for holding the seat member 20 in position. In order to reduce the weight of the portable combination chair 10, all members of the chair 10 are made of hollow plastic plates by mold injection.

The seat member 20, as shown in FIG. 2, has an elongated back slot 21 provided at a back side edge thereof, an elongated left slot 22 and an elongated right slot 23 parallelly provided at a left side edge and a right side edge of the seat member 20 respectively, in which the distance between the left slot 22 and the right slot 23 is preferred to be larger than a length of the back slot 21. The shape of the seat member 20 is not limited to rectangular, square, or circular shape, and that even some curly, oval or wavy shape are all acceptable. The shape of the seat member 20 that has sharp edge such as square, rectangular, or triangle would need to dull the edge for the sake of safety of the children.

The back supporting member 30 has an upper back supporting portion 31 and a lower connecting portion 32 extending downwards from the upper back supporting portion 31 and having a left and a right connecting wing 33, 34 integrally extended downwardly and outwardly therefrom respectively. The upper back supporting portion 31 has a width and a thickness slightly smaller than the length and a width of the back slot 21 of the seat member 20 respectively. The left and right connecting wings 33, 34 of the lower connecting portion 32 are protruded outwardly to the left of a left side edge 311 and the right of a right side edge 312 of the upper back supporting portion 31 respectively, as to defined a left top supporting shoulder 35 and a right top supporting shoulder 36 adjacent to the bottom ends of the left side edge 311 and the right side edge 312 of the upper back supporting portion 31. Two connecting grooves 37, 38 having a predetermined depth and a predetermined width are indented at the bottom ends of the left and the right connecting wing 33, 34 respectively. The distance between the two connecting grooves 37, 38 is preferred to be equal to the distance between the left and right slots 22, 23 of the seat member 20. At least a handle opening 301 is formed at a top area of the upper back supporting portion 31 for hand gripping.

The securing means 60 comprises a first set of lockers 61 protruded on the surface of the upper back supporting portion 31 and positioned at a predetermined location higher than the two supporting shoulder 35, 36 so as to defining a distance therebetween equal to the thickness of the seat member 20.

The left arm resting member 40 and the right arm resting member 50 are basically identical in structure, each of which has a curved bottom side 41, 51 and an upper arm resting portion 42, 52 extending upwardly. The upper arm resting portion 42, 52 has a narrowed width defining a front supporting shoulder 43, 53 and a rear supporting shoulder 44, 54 extending frontwardly and rearwardly from a front side 421, 521 and a rear side 422, 522 of the upper arm resting portion 42, 52 respectively. The width of the left and right upper arm resting portions 42, 52 must be slightly smaller than the length of the left and the right slot 22, 23 of the seat member 20 respectively. Each of the left and right arm resting members 40, 50 further has a rear slot 45, 55, which has a length slightly longer than the height of the left and the right wing 33, 34 respectively, adapted for enabling the left and right connecting wings 33, 34 to pass through respectively.

Figure 3:
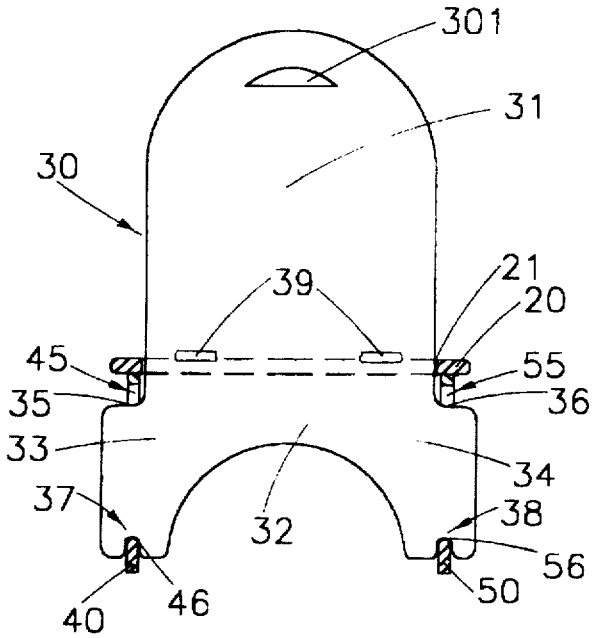
FIG. 3 is a partial sectional front view of the portable combination chair, along A–A' sectional line in FIG. 1, according to the above first preferred embodiment of the present invention.

As shown in FIG. 3, the back supporting member 30 is designed to be capable of locking with the left arm resting member 40 and the right arm resting member 50 by downwardly engaging the two connecting grooves 37, 38 of the two connecting wings 33, 34 respectively with a bottom end portion 46, 56 of the rear slot 45, 55 of the left and the right arm resting member 40, 50. Such locking relationship is simple but effective because the back supporting member 30 tends to maintain the engagement between the two connecting grooves 37, 38 and the two bottom end portions 46, 56 due to gravity. Under this engaging connection, the left and the right arm resting member 40, 50 would not detach from the back supporting member 30 unless the user purposely lifts up the back supporting member for a height larger than the depth of the connecting grooves 37, 38 during disassembling.

As shown in FIGS. 1 and 2, the seat member 20 has an additional function of securely locking the back supporting member 30 with the left and right arm resting members 40, 50 to form a rigidly constructed combination chair 10. The seat member 20 is assembled by inserting the upper back supporting portion 31 of the back supporting member 30 and the upper arm resting portions 42, 52 of the left and right arm resting members 40, 50 through the back slot 21 and the left and right slots 22, 23 respectively until a bottom surface of the seat member 20 is rested on the front supporting shoulders 43, 53 and the rear supporting shoulders 44, 54 of the left and right arm resting members 40, 50 respectively. In accordance with the assembly disclosed above, when the user sits on the seat member 20 of the portable combination chair 10 as shown in FIG. 1, the weight of the user would press the seat member 20 remaining downwards and thus the four members, including the seat member 20, the back supporting member 30, the left arm resting member 40, and the right arm resting member 50, are firmly locked in position with each other.

Figure 4:
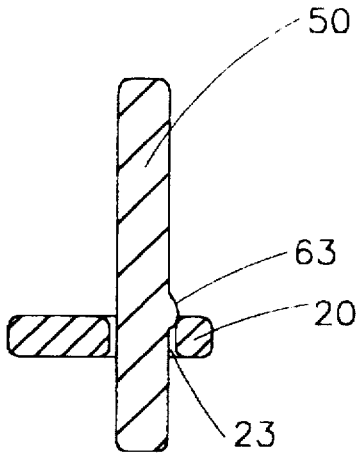
FIG. 4 is a partial enlarged sectional view illustrating the locking structure of the slot and protrusion according to above first preferred embodiment of the present invention.

As shown in FIGS. 1 and 4, the securing means 60 further comprises a second and a third sets of safety lockers 62, 63 which are protruded at a predetermined location on the outer surfaces of the left and right upper arm resting portions 42, 52 of the left and right arm resting members 40, 50 respectively. The second and third sets of lockers 62, 63 are positioned higher than the front and rear supporting shoulders 43, 44, 53, 54 for a distance equal to the thickness of the seat member 20, so that the seat member 20 can be forced to position between the first, second and third sets of lockers 61, 62, 63 and the front and rear supporting shoulders 43, 44, 53, 54 unless a lift-up force is applied to the seat member 20 to compress the lockers 61, 62, 63 for detaching the seat member 20 during disassembling.

Figure 5:
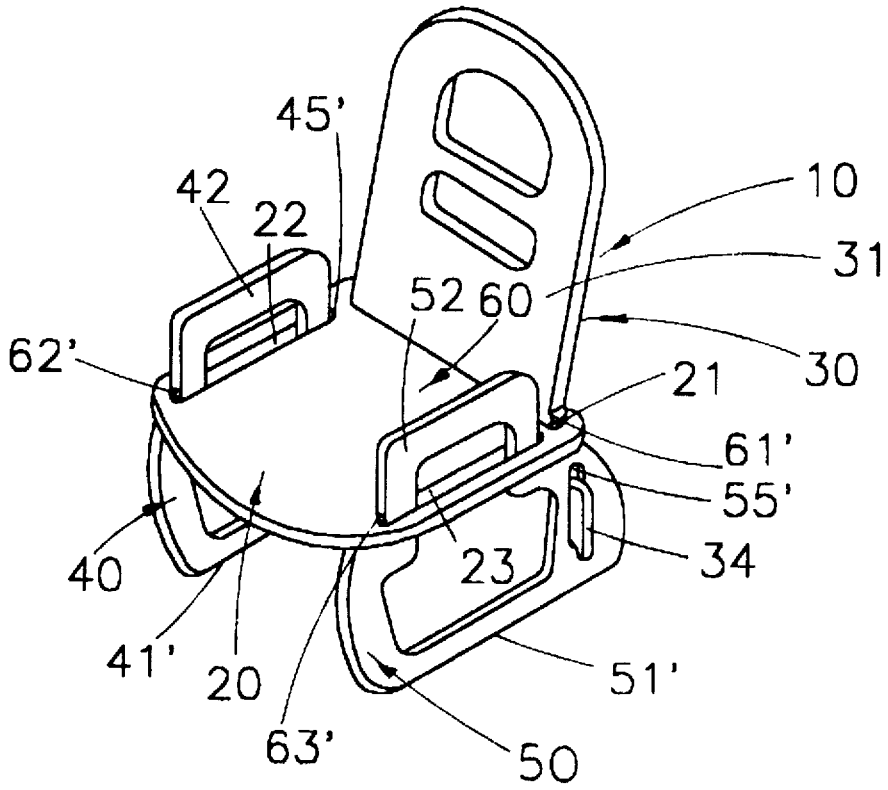
FIG. 5 is a perspective section view of a portable combination chair according to a second preferred embodiment of the present invention.

Referring to FIG. 5, a second preferred embodiment of the present invention is illustrated, which has the basic assembling construction as the above first preferred embodiment. However, different shapes of the seat member 20, the back supporting member 30, and the left and the right arm resting member 40, 50 are illustrated, wherein both the left and the right arm resting member 40, 50 each has a flat bottom side 41', 51'. The rear slots 45', 55' of the left and right arm resting members 40, 50 are made to be inclined with a predetermined angle so as to enable the back supporting member 30 positioned inclinedly. Moreover, the first, second and third sets of lockers 61', 62', 63' of the securing means 60 are protruded at the two side edges of the bottom end of the upper back supporting portion 31, the front side edges and the rear side edges of the upper front and rear arm supporting portions 42, 52 respectively. It is worth to mention that the children may select different shaped members to assemble a chair of various appearance according to their ability of creation and organization.

To assembly the portable combination chair 10 of the present invention, 1) choose the shape, size, and art form of all four members of the portable combination chair that is desired to constructed;

2) as shown in FIG. 2, hold the back supporting member 30 straight up then insert the left connecting wing 33 through the rear slot 45 of the left arm resting member 40 and the right connecting wing 34 through the rear slot 55 of the right arm resting member 50;

3) then engage the two connecting grooves 37, 38 with the bottom end portions 46, 56 of the two rear slots 45, 55 of the left and right arm resting members 40, 50 to connect the back supporting member 30 with the left and right arm resting members 40, 50; and 4) lower the seat member 20, with the back supporting member 20 passing through the back slot 21, the upper arm resting portion 42 of the left arm resting member 40 passing through the left slot 22, and the upper arm resting portion 52 of the right arm resting member 50 passing through the right slot 23, until the bottom surface of seat member 30 resting on the front and rear supporting shoulders 43, 44, 53, 54, so that the portable combination chair 10 is rigidly and stably assembled.

Since the entire portable combination chair 10 of the present invention comprises merely four members, it is easy to assemble, disassemble, store, and carry. The user may disassemble and reassemble the chair easily and promptly during outing. Furthermore, the construction of the chair is firm, stable and tight by taking the structural advantage of the engagement between the two connecting grooves 37, 38 of the back supporting member 30 and the two rear slots 45, 55 of the left and right arm resting members 40, 50. The present invention also simplify its overall construction that no additional connecting element such as screw or bolt is required, and thus it enables a child to easily disassemble and assemble the chair.

What is claimed is:

1. A portable combination chair, comprising a seat member having an elongate back slot provided at a back side disassembling edge thereof, an elongated left slot and an elongated right slot provided at a left side edge and a right side edge of said seat member respectively;

a back supporting member which has an upper back supporting portion and a lower connecting portion extending downwards from said upper back supporting portion, said lower connecting portion having a left and a right connecting wing integrally extended downwardly and outwardly therefrom respectively, said upper back supporting portion having a width and a thickness slightly smaller than a length and a width of said back slot of said seat member respectively, wherein said left and right connecting wings of said lower connecting portion are protruded outwardly from a left side edge and a right side edge of said upper back supporting portion respectively, said left connecting wing having a left connecting groove, which has a predetermined depth and a predetermined width, indented at a bottom end of said left connecting wing and said right connecting wing also having a right connecting groove, which has a predetermined depth and a predetermined width, indented at a bottom end of said right connecting wing; and a pair of left arm resting member and right arm resting member, each of which has an upper arm resting portion extending upwardly, which has a narrowed width defining a front supporting shoulder and a rear supporting shoulder extending frontwardly and rearwardly from a front side and a rear side of said upper arm resting portion respectively, wherein said width of said left and right upper arm resting portions is smaller than a length of said left and said right slot of said seat member respectively, each of said left and right arm resting members further having a rear slot, which has a length longer than a height of said left and said right wing respectively, adapted for enabling said left and right wings to pass through respectively; so that said back supporting member is capable of locking with said left arm resting member and said right arm resting member by downwardly engaging said two connecting grooves of said two connecting wings respectively with a bottom end portion of said rear slot of said left arm resting member and a bottom end portion of said rear slot of said right arm resting member respectively, moreover, said seat member is assembled by inserting said upper back supporting portion of said back supporting member and said upper arm resting portions of said left and right arm resting members through said back slot and said left and right slots of said seat member respectively until a bottom surface of said seat member is rested on said front supporting shoulders and said rear supporting shoulders of said left and right arm resting members respectively.

2. A portable combination chair, as recited in claim 1, further comprising a securing means for locking the seat member in position.

3. A portable combination chair, as recited in claim 2, in which said securing means comprises a first set of lockers protruded on a surface of said upper back supporting portion and positioned at a predetermined location higher than said two front and rear supporting shoulders of said left and right arm resting members for a distance equal to a thickness of said seat member.

4. A portable combination chair, as recited in claim 3, in which said securing means further comprises a second and a third sets of safety lockers which are protruded at a predetermined location on an outer surface of said left upper arm resting portion and an outer surface of said right upper arm resting portions of said left and right arm resting members respectively, said second and third sets of lockers being positioned higher than said front and rear supporting shoulders of said left and right arm supporting members for a distance equal to said thickness of said seat member, so that said seat member is assembled to position between said first, second and third sets of lockers and said front and rear supporting shoulders.

5. A portable combination chair, as recited in claim 4, in which a distance between said left and right connecting grooves is equal to a distance between said left and right slots of said seat member.

6. A portable combination chair, as recited in claim 4, in which each of said left and right arm resting members has a curved bottom side.

7. A portable combination chair, as recited in claim 3, in which said securing means further comprises a second and a third sets of safety lockers which are protruded at a predetermined location on a front and a rear side edge of said left upper arm resting portion and a front and a rear side edge outer surface of said right upper arm resting portions of said left and right arm resting members respectively, said second and third sets of lockers being positioned higher than said front and rear supporting shoulders of said left and right arm supporting members for a distance equal to said thickness of said seat member, so that said seat member is assembled to position between said first, second and third sets of lockers and said front and rear supporting shoulders.

8. A portable combination chair, as recited in claim 7, in which a distance between said left and right connecting grooves is equal to a distance between said left and right slots of said seat member.

9. A portable combination chair, as recited in claim 7, in which each of said left and right arm resting members has a flat bottom side.

10. A portable combination chair, as recited in claim 2, in which said securing means comprises a first and a second sets of safety lockers which are protruded at a predetermined location on an outer surface of said left upper arm resting portion and an outer surface of said right upper arm resting portions of said left and right arm resting members respectively, said first and second sets of lockers being positioned higher than said front and rear supporting shoulders of said left and right arm supporting members for a distance equal to said thickness of said seat member, so that said seat member is assembled to position between said first and second sets of lockers and said front and rear supporting shoulders.

11. A portable combination chair, as recited in claim 2, in which said securing means comprises a first set of lockers protruded on a left side edge and a right side edge of said upper back supporting portion and positioned at a predetermined location higher than said two front and rear supporting shoulders of said left and right arm resting members for a distance equal to a thickness of said seat member.

12. A portable combination chair, as recited in claim 2, in which said securing means comprises a first and a second sets of safety lockers which are protruded at a predetermined location on a front and a rear side edge of said left upper arm resting portion and a front and a rear side edge of said right upper arm resting portions of said left and right arm resting members respectively, said first and second sets of lockers being positioned higher than said front and rear supporting shoulders of said left and right arm supporting members for a distance equal to said thickness of said seat member, so that said seat member is assembled to position between said first and second sets of lockers and said front and rear supporting shoulders.

13. A portable combination chair, as recited in claim 2, in which a distance between said left and right connecting grooves is equal to a distance between said left and right slots of said seat member.

14. A portable combination chair, as recited in claim 2, in which each of said left and right arm resting members has a curved bottom side.

15. A portable combination chair, as recited in claim 2, in which each of said left and right arm resting members has a flat bottom side.

16. A portable combination chair, as recited in claim 1, in which a distance between said left and right connecting grooves is equal to a distance between said left and right slots of said seat member.

17. A portable combination chair, as recited in claim 16, in which each of said left and right arm resting members has a curved bottom side.

18. A portable combination chair, as recited in claim 1, in which at least a handle opening is formed at a top area of said upper back supporting portion for hand gripping.

19. A portable combination chair, as recited in claim 1, in which each of said left and right arm resting members has a curved bottom side.

20. A portable combination chair, as recited in claim 1, in which each of said left and right arm resting members has a flat bottom side.

* * * * *